US005278582A

United States Patent [19]

Hongo

[11] Patent Number: 5,278,582

[45] Date of Patent: Jan. 11, 1994

[54] PRINTER DRIVING CIRCUIT

[75] Inventor: Yutaka Hongo, Tokyo, Japan

[73] Assignee: Seiko Instruments, Inc., Tokyo, Japan

[21] Appl. No.: 357,789

[22] Filed: May 30, 1989

[30] Foreign Application Priority Data

May 27, 1988 [JP] Japan ..... 63-131112

[51] Int. Cl.[5] ..... B41J 2/045

[52] U.S. Cl. ..... 346/140 R; 400/121

[58] Field of Search ..... 346/75, 140; 400/279, 400/280, 121; 250/548

[56] References Cited

U.S. PATENT DOCUMENTS 3,578,129 5/1971 Kato et al. ..... 400/281
4,320,406 3/1982 Heinzl ..... 346/140 R
4,344,079 8/1982 Chambors ..... 346/140
4,515,487 5/1985 Minami ..... 400/121
4,675,696 6/1987 Suzuki ..... 346/46
5,102,244 4/1992 Takeda ..... 400/121

*Primary Examiner*—Joseph W. Hartary
*Attorney, Agent, or Firm*—Spensley Horn Jubas & Lubitz

[57] ABSTRACT

A driving circuit of an on-demand ink jet printer having a head with injection nozzles disposed in a matrix, wherein data is read out of a picture memory in which data of a pattern to be printed is stored at two-dimensional coordinate addresses, by using a nozzle position coordinate as a memory address, a pixel signal at each instant for each nozzle is fed to a piezo driving signal generation circuit directly from the picture memory, thereby realizing a simple method to compensate for different locations of the individual nozzles.

18 Claims, 4 Drawing Sheets

ENCODER
1
COORDINATE COUNTER
2
5
50b
PICTURE MEMORY
3
30
DRIVING SIGNAL GENERATOR
6
CORECTION REGISTER
4·L1
4·L2
CONTROL CIRCUIT
7
50·a
60·a
60·b
60·c
60·d
60·e
60·f
60·g
60·h
9·a
9·b
9·c
9·d
9·e
9·f
9·g
9·h
9
8
L1
L2
4·P
P
(A)
Y
(B)
X

| NOZZLE / TIME | 9a | 9b | 9c | 9d | 9e | 9f | 9g | 9h |
|---|---|---|---|---|---|---|---|---|
| 1 | 0 | 1 | 0 | 1 | 0 | 1 | 0 | 1 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 1 | 0 | 1 | 0 | 1 | 0 | 1 | 0 |

PRINTER DRIVING CIRCUIT

BACKGROUND OF THE INVENTION

This invention relates to a printer driving circuit for a printer having a head with a plurality of dot printing members disposed in a matrix, and more particularly an on-demand ink jet printer having a head with a plurality of ink-jet nozzles disposed in a matrix.

In a printer having a nozzle array in a plurality of lines parallel to the direction in which a head scans, a prior art method for correcting a dislocation of the print position of such array provides that the drive timing of the piezo device corresponding to a nozzle located rearwardly of the direction in which the head advances is delayed for the nozzle interval.

Thus, a retardation mechanism such as a shift register or the like is necessary for the nozzle interval adjustment, which involves difficulty in coping with the multi-nozzle construction prevailing of late.

SUMMARY OF THE INVENTION

It is therefore an object of the invention to provide a printer driving circuit for correcting a dislocation of the print position of a head with nozzles multiplied or so disposed in plural lines to the direction in which the head scans.

This and other objects of the invention are accomplished by a printer driving circuit comprising detecting means for detecting the head position, a picture memory for storing print data of at least one scan by the print head associated with position values of pixel data on the sheet being printed, position generating means coupled with the detecting means for generating indications of the respective positions of the nozzle on the sheet, read out means coupled with the position generating means for reading out the pixel data stored in the picture memory associated with position values of respective nozzle positions on the sheet, and driving means coupled with the read out means for driving the printing means according to the pixel data read out.

A read out from a picture memory is carried out for each nozzle, and the picture memory, a detecting means, a position generating means, and a read out means are connected so that a two dimensional coordinate value with the printing pitch on a sheet in which each nozzle exists at each print timing as unitary therefor will constitute at least one part of a read out address of the picture memory. That is, all the nozzle positions may be indicated by a relative position from a reference nozzle determined virtually. Therefore, if an absolute position of the reference nozzle on a sheet is selected, then absolute positions of all the nozzles on the sheet are fixed. A value obtained in the position generating means is supplied to the memory to read out as an address of the picture memory. The operation is applied on all the nozzles between one print timing, or interval, and the next print timing. The read out pixel data are set on the driving means, and thus all the nozzles, or piezo elements, are driven at the same time on the basis of a predetermined print timing.

DESCRIPTION OF THE PREFERRED EMBODIMENT

The invention will now be described with reference to the accompanying drawings representing preferred embodiments thereof.

Figure 1:
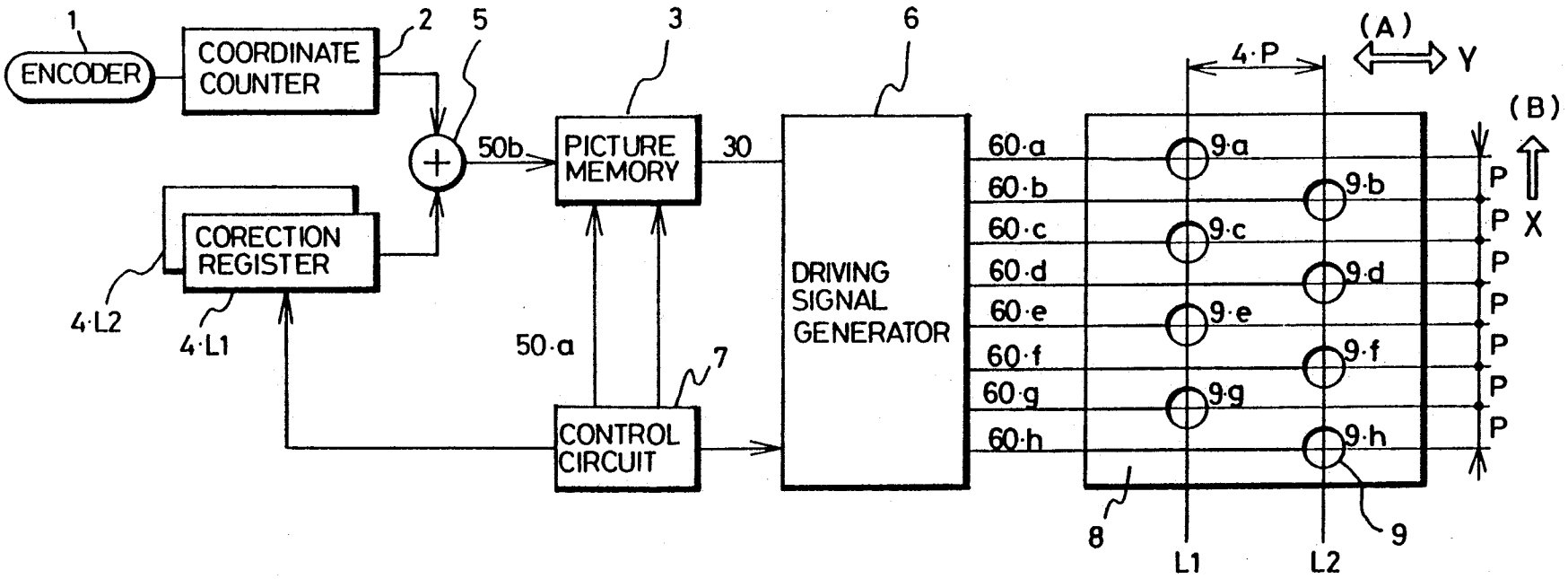
FIG. 1 is a block diagram of a first embodiment of the invention.

The first embodiment, shown in FIG. 1, relates to a head with nozzles having an offset arrangement from row to row for minimizing the printing dot pitch so as to enhance resolution.

For simplicity of the description, it will be assumed that eight nozzles 9.*a* to 9.*h* are arrayed in an offset, or zigzag, fashion on a head 8, with four nozzles being on each of two lines L1, L2. Line L1 is separated from line L2 by a multiple of a pitch P. Head 8 scans (main scanning) horizontally of a sheet by the pitch P, and the form is fed (subscanning) vertically thereof by the pitch P. A belt-like picture image P in dot pitch and 8 dots in width is formed on the form by scanning the head for printing. Outputs 60.*a* to 60.*h* of a piezo driving signal generation circuit 6 are each connected to a respective nozzle 9. Then, a piezo device and the nozzle are regarded as equivalent electrically on the drawing.

A pixel signal 30 inputted to the piezo driving signal generation circuit 6 is an output signal from a picture memory 3, which can be regarded as a one spot print data on a two-dimensional plane indicated by X and Y on the sheet being printed. In other words, picture memory 3 represents a two-dimensional plane assigning an upper order 50.*a* of an address signal to the picture memory 3 to the X-coordinate and a lower order 50.*b* to the Y-coordinate, and hence, it can be said that the pixel signal 30 of an arbitrary coordinate may be read by applying values of X and Y (=addresses). Accordingly, the picture memory 3 developed on the two-dimensional plane with the dot pitch P as the elemental unit can be regarded as having the same plane as the sheet.

The lower order address 50.*b* (=Y-coordinate) of the picture memory 3 is obtainable by combining the contents of a coordinate counter 2 and a correction register 4 in an adder 5. The coordinate counter 2 indicates a coordinate of the head 8, counting the output pulses of an encoder 1 in the example. The encoder 1 is mounted on a shaft of a head scan driving motor (not indicated), generating a number of pulses corresponding to a moving rate based on a motor rotation or head shift. Here, one count of the coordinate counter 2 is equal to the dot pitch P.

It should be noted that the content of correction register 4, to be described below, may vary according to which portion of the head 8 corresponds to the value indicated by the coordinate counter 2. If a coordinate value of line L1 is adjusted exactly to the value indicated by the coordinate counter 2, then a value 0 is set to a correction register 4.L1 for line L1, and a value 4 is set to a correction register 4.L2 for line L2. That is, the value 0 is added to the content of the coordinate counter 2 to indicate the Y-coordinate of L1, and an interline gap 4 is added to obtain the Y-coordinate of L2.

Figure 2:
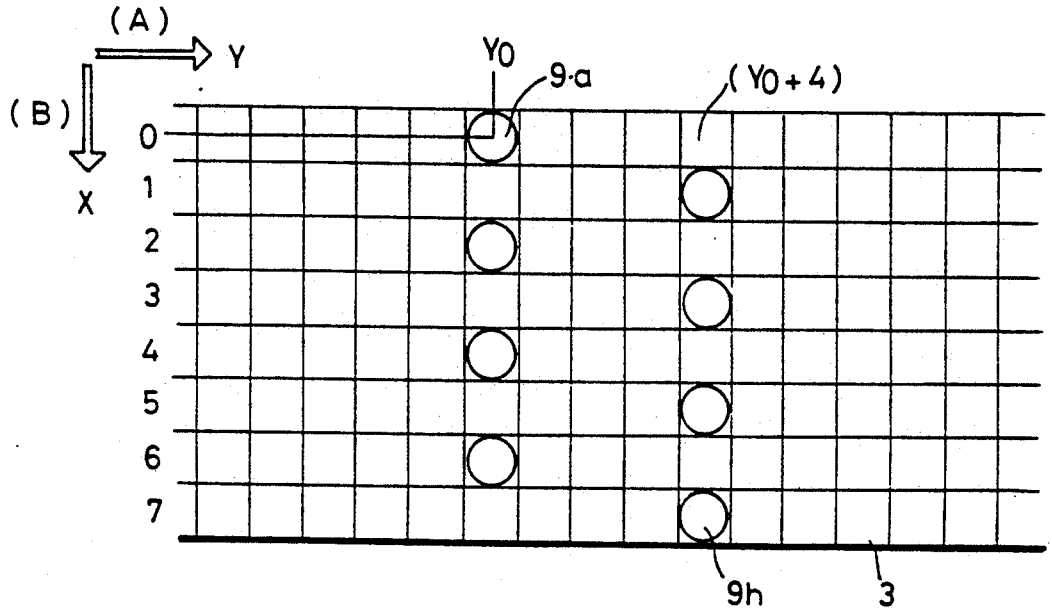
FIG. 2 is an explanatory drawing wherein a nozzle array is projected onto a picture memory.

This is further clarified by FIG. 2. If the picture memory 3 is conceived to be a belt-like space 8 dots in width, then each square of the grid of FIG. 2 represents a dot position. Therefore, if a coordinate of nozzle 9.*a* is selected to be (0, $Y_0$), the positions of the other nozzles are automatically fixed, and, for example, the position of nozzle 9.*h* becomes (7, $Y_0+4$). Thus, the position of a nozzle on the sheet being printed can be projected onto the picture memory 3 by drawing the picture memory 3 as a two-dimensional plane.

Next, the X-coordinate (=upper order address 50.*a of* the picture memory) can easily be generated by providing a 3-bit counter in a control circuit 7, if the picture memory 3 is conceived to be a belt-like space 8 dots in width (X direction). The output of the counter itself is the X-coordinate and one input of the adder 5 will be selected to be from L1 correction register 4.L1 or L2 correction register 4.L2 based on the value of the least significant bit of the output from the counter in control circuit 7. A description will be given in order.

The 3-bit counter in the control circuit 7 is called X-counter. First, the X-counter starts from a value 0, and if the coordinate of L1 is $Y_0$ of FIG. 2, then the pixel data 30 for the nozzle 9.*a* is read from address (0, $Y_0$) and supplied to the piezo driving signal generator 6. In this case, the least significant bit of the X-counter is also 0 (even), and the correction register 4.L1 is selected. Next, the count produced by the X-counter is plus 1, so that correction register 4.L2 is selected, and the output 50.*b* of the adder 5 is $Y_{0+}4$ in value. Accordingly, the pixel data 30 for nozzle 9.*b* is read from address (1, $Y_0+4$). Next, the X-counter count advances from plus 1 to be 2, and since this count is an even number, the correction register 4.L1 is selected. Accordingly, the pixel data for nozzle 9.*c* is read from address (2, $Y_0$) of memory 3. The control circuit 7 repeats the above operation for nozzles 9.*c* to 9.*h*, sets the eight pixel data values in respective registers in piezo driving signal generator 6, and drives all piezo elements at once with a predetermined print timing through driving signals 60.*a* to 60.*h*.

Figures 3A, 3B:
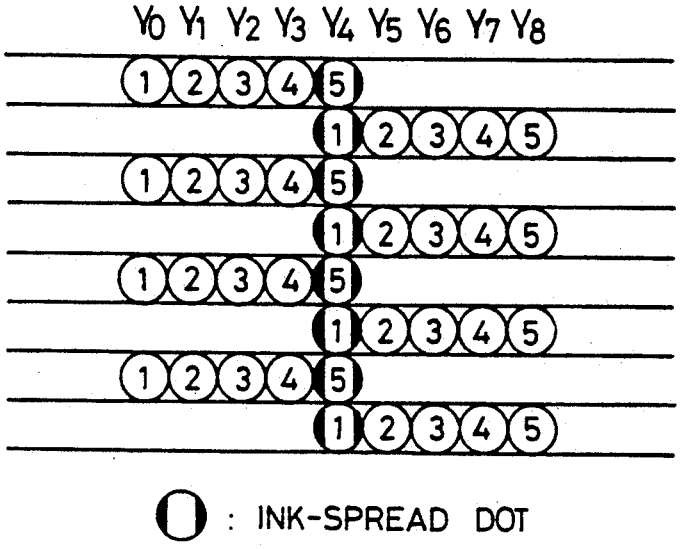
FIG. 3 is an explanatory drawing representing print data and a sequence for drawing a vertical line in the first embodiment.

As shown in FIGS. 3, if a vertical line is printed along a main scanning coordinate $Y_4$, a value 1 (1 represents ink injection) is written in at 8 X-coordinates at $Y=Y_4$ in the picture memory 3. Accordingly, when the coordinate counter 2 indicates $Y=Y_0$, what is set on the piezo driving signal generation circuit 6 is a data 1 written as a time 1. Similarly, a list of the pixel signals 30 at the times of 1 to 5 and $Y=Y_0$ to $Y_4$ and a generation and list of dots on the sheet are indicated as the data at the time of $Y=Y_1$ is 2. It is apparent from FIG. 3B that at time 1 nozzles 9.*b*, 9.*d*, etc., are activated and at time 5 nozzles 9.*a*, 9.*c*, etc., are activated.

Now, as will be apparent from the description given above, unless the value indicated by the coordinate counter 2 is a coordinate of L1, a value plus the gap will be set on each correction register 4. While the example relates to two lines L1 and L2, it goes without saying that a zigzag arrangement in three lines or more is also applicable.

Figure 4:
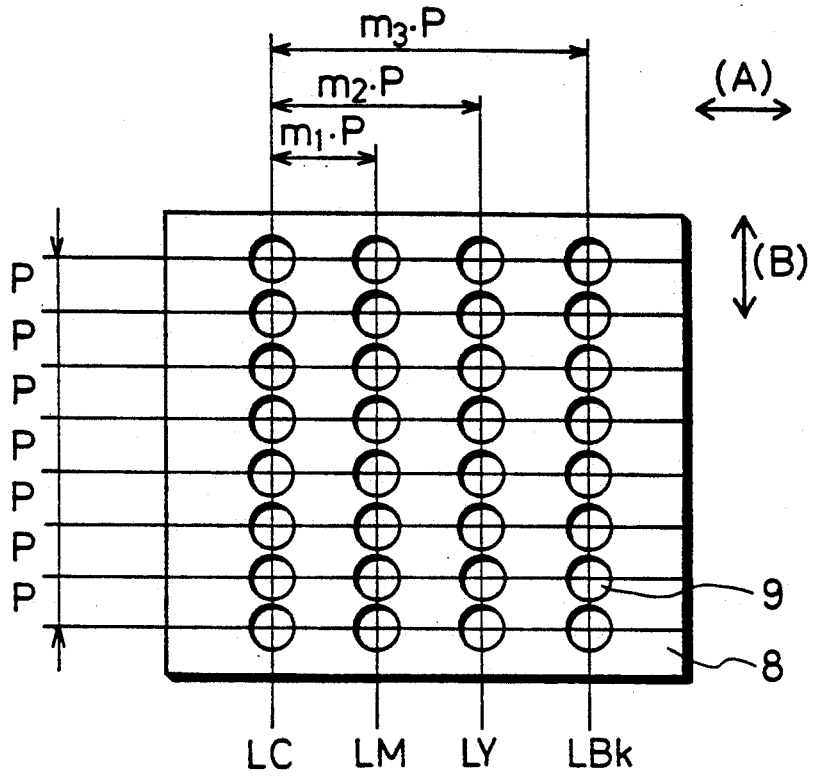
FIG. 4 is an explanatory drawing illustrating the nozzle array on a head in a second embodiment.

An application to the head of multinozzle construction for full-color printing will be described as a second embodiment. In FIG. 4, the line denoted by LC is a nozzle line for jetting a cyan ink, Lm is a magenta ink nozzle line, LY is a yellow ink nozzle line, and LBk is a black ink nozzle line. However, the invention is not limited to this color assortment. A system equivalent to the block diagram given in FIG. 1 may be taken also in the second embodiment.

Figure 5:
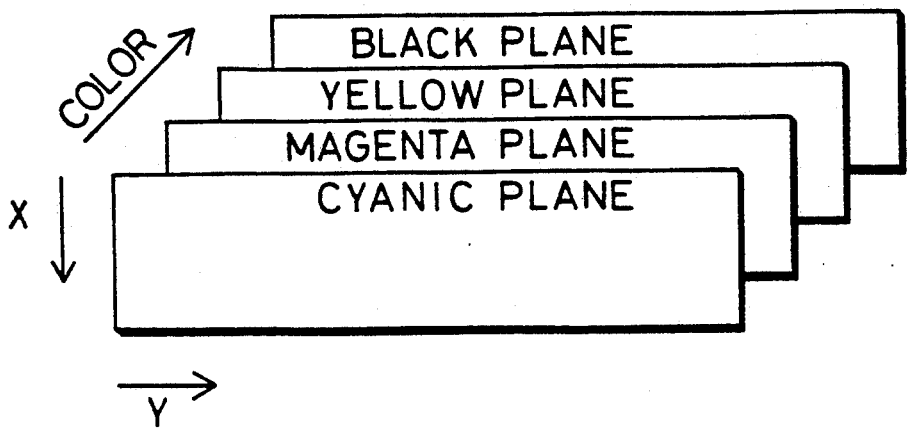
FIG. 5 is an explanatory drawing showing the construction of a picture memory in the second embodiment.

However, what is different is the structure of the picture memory 3, first. A color dimension joins further and hence the memory is conceived to be a three-dimensional space having a depth of color as shown in FIG. 5. As for X and Y, the conception is exactly the same as the first embodiment. Accordingly, the upper order address 50.*a* provided to the picture memory 3 by the control circuit 7 comes in 5 bits all told or 3 bits for X-coordinate plus 2 bits for color plane specification.

The second difference is that the correction register 4 is provided in four parts for the nozzle array composed of four lines. If a value indicated by the coordinate counter 2 represents a coordinate of line LC of the head 8, as in the case of the first embodiment, a value 0 is set on the LC correction register, a value $m_1$ indicated in FIG. 4 is set on the LM correction register, a value $m_2$ is set on the LY correction register, and a value $M_3$ is set on the LBk correction register.

In this case, the control circuit 7 operates as follows. Three bits for the X-coordinate plus two bits for the color plane specification are provided by one counter, starting from an initial value of 0. The correction register 4 is selected by the two most significant bits (color plane specification) of the aforementioned five bits. The Y-coordinate is obtained by adding the value provided by the coordinate value counter 2 and the value from the LC correction register, and as the X-coordinate value increases in unitary steps, the pixel signal 30 for the eight cyan ink nozzles is set in the piezo driving signal generator 6. Only the three bits' lower order operating for the X-coordinate, the X-coordinate value returns to 0 after all eight cyan nozzles have been addressed, and the count represented by the two bits for color plane specification advanced by 1. Thus, the mode is magenta plane specification of the picture memory 3, and the LM correction register is selected for the correction register 4 concurrently. Through the above operations carried out in sequence, the pixel signal 30 corresponding to the 32 nozzles 9 all told (8×4) as shown in FIG. 4 is set on respective registers in the piezo driving signal generator 6 for printing with a predetermined timing.

Thus, memory 3 stores data representing the printed pixel value at each location of a region of the sheet, at addresses corresponding to the locations, and then data are read out from those addresses which are associated with the current position of the print head.

While not specifically illustrated, the invention is also applicable to a combination of both the first and second embodiments, wherein one nozzle array per color is given a zigzag form to cover the number of ink colors and is further applicable to other types of printers having dot print members arranged in a matrix in a print head.

As described in detail above, the invention does not require any retardation mechanism, and is capable of realizing easily a correction of print position variations of a multinozzle construction.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A printer driving circuit for a printer having a printer head which is mounted to scan perpendicularly to a direction in which a sheet to be printed upon is fed, the printer head including a plurality of dot printing means disposed in a matrix at intervals of a predetermined pitch, said printer driving circuit comprising:

detecting means for detecting the position of the head, said detecting means comprising a counter for counting coordinate values associated with positions of the printer head in the direction of head scanning;

a picture memory for storing print data associated with at least one scan by the printer head at addresses corresponding to printed pixel locations on the sheet;

position generating means coupled with said detecting means for generating representations of respective positions of the printing means on the sheet, said position generating means comprising storage means for storing correction values for respective printing means;

read out means coupled with said position generating means for reading out the pixel data stored in said picture memory at addresses corresponding to the positions of the printing means relative to the sheet; and driving means coupled with said read out means for driving said printing means according to the pixel data read out by said read out means.

2. A printer driving circuit as claimed in claim 1 wherein the printing means includes piezo driven ink-jet nozzles.

3. A printer driving circuit as claimed in claim 1 wherein said position generating means comprise arithmetic operation means for generating representations of respective positions of said printing means from a coordinate value and a correction value.

4. A printer driving circuit as claimed in claim 1 wherein said position generating means comprise a counter for counting a coordinate value in the direction of feeding of the sheet.

5. A printer driving circuit as claimed in claim 1 wherein said driving means comprise a plurality of registers for storing read out pixel data.

6. A printer driving circuit as claimed in claim 1 wherein said plurality of printing means are arranged in a zigzag pattern.

7. A printer driving circuit as claimed in claim 1 wherein said plurality of printing means includes color printing means for printing a color image.

8. A printer driving circuit as claimed in claim 7 wherein said picture memory stores print data at addresses corresponding to the printed pixel locations and color information of the pixel data.

9. A print driving circuit as claimed in claim 8 wherein said position generating means includes means for generating color information.

10. A printer for printing a picture on a sheet comprising:

a printer head for printing a picture including a plurality of dot printing means;

a form feeder for feeding the sheet relative to said head;

printer head scanning means for moving said printer head across the sheet perpendicularly to the direction in which the sheet is fed by said feeder;

detecting means for detecting the current position of said head across the sheet, said detecting means comprising a counter for counting coordinate values associated with positions of said head in the direction of head scanning;

a picture memory for storing print data associated with at least one scan by said head at addresses corresponding to printed pixel location on the sheet;

position generating means coupled with said detecting means for generating representations of respective positions of said printing means on the sheet, said position generating means comprising storage means for storing correction values for respective printing means;

read out means coupled with said position generating means for reading out the pixel data stored in said picture memory at addresses corresponding to the positions of the printing means relative to the sheet; and driving means coupled with said read out means for driving said printing means according to the pixel data read out by said read out means.

11. A printer as claimed in claim 10 wherein said printing means includes a piezo driven ink-jet nozzle.

12. A printer as claimed in claim 10 wherein said position generating means comprise arithmetic operation means for generating representations of respective positions of said printing means from a coordinate value and a correction value.

13. A printer as claimed in claim 10 wherein said position generating means comprise a counter for counting coordinate values associated with positions of the head in the direction of feeding of the sheet.

14. A printer as claimed in claim 10 wherein said driving means comprise a plurality of registers for storing read out pixel data.

15. A printer a claimed in claim 10 wherein said plurality of printing means are arranged in a zigzag pattern.

16. A printer as claimed in claim 10 wherein said plurality of printing means includes color printing means for printing a color image.

17. A printer as claimed in claim 16 wherein said picture memory stores print data at addresses corresponding to the printed pixel locations and color information of the pixel data.

18. A printer as claimed in claim 17 wherein said position generating means include means for generating color information.

* * * * *